US007561705B2

(12) United States Patent
Akino

(10) Patent No.: US 7,561,705 B2
(45) Date of Patent: Jul. 14, 2009

(54) REDUCTION OF FLUX LEAKAGE IN A DYNAMIC MICROPHONE

(75) Inventor: Hiroshi Akino, Machida (JP)

(73) Assignee: Kabushiki Kaisha Audio-Technica, Machida-Shi, Tokyo (JP)

( * ) Notice: Subject to any disclaimer, the term of this patent is extended or adjusted under 35 U.S.C. 154(b) by 841 days.

(21) Appl. No.: 11/146,004

(22) Filed: Jun. 7, 2005

(65) Prior Publication Data

US 2005/0276428 A1 Dec. 15, 2005

(30) Foreign Application Priority Data

Jun. 14, 2004 (JP) ..... 2004-175266

(51) Int. Cl.

| | |
|---|---|
| ***H04R 25/00*** | (2006.01) |
| *H04R 9/08* | (2006.01) |
| *H04R 11/04* | (2006.01) |
| *H04R 17/02* | (2006.01) |
| *H04R 19/04* | (2006.01) |
| *H04R 21/02* | (2006.01) |
| *H04R 1/00* | (2006.01) |
| *H04R 9/06* | (2006.01) |
| *H04R 11/02* | (2006.01) |

(52) U.S. Cl. ..... 381/177; 381/359; 381/396; 381/412; 381/420; 381/421

(58) Field of Classification Search ..... 381/421, 381/359

See application file for complete search history.

(56) References Cited

U.S. PATENT DOCUMENTS 3,830,333 A * 8/1974 Knauert ..... 181/175
6,940,992 B2 * 9/2005 Stiles ..... 381/412

FOREIGN PATENT DOCUMENTS

JP H11-331983 11/1999

* cited by examiner

*Primary Examiner*—Brian Ensey
*Assistant Examiner*—Matthew Eason
(74) *Attorney, Agent, or Firm*—Manabu Kanesaka

(57) ABSTRACT

Leakage flux is reduced particularly in a magnetic gap of a magnetic circuit to improve the sensitivity of a dynamic microphone. A dynamic microphone including a magnetic circuit unit 20 including a center pole piece 22 connected to one pole of a first permanent magnet 21 and a yoke 23 which is connected to the other pole of the first permanent magnet 21 and is arranged like a ring around the center pole piece 22 via a magnetic gap of a predetermined width, a diaphragm 10 having voice coils 13 disposed in the magnetic gap, and a resonator 40 which has a front acoustic terminal 41 and is disposed at the front of the diaphragm 10, the dynamic microphone further including a second permanent magnet 43 disposed on a part of the resonator 40 so as to face the center pole piece 22, the second permanent magnet 43 being polarized in such a way that the same poles of the first permanent magnet 21 and the second permanent magnet 22 face each other.

4 Claims, 1 Drawing Sheet

REDUCTION OF FLUX LEAKAGE IN A DYNAMIC MICROPHONE

TECHNICAL FIELD

The present invention relates to a dynamic microphone, and more specifically to a technique for improving sensitivity by reducing magnetic leakage in a magnetic circuit unit provided in a dynamic microphone.

BACKGROUND ART

A dynamic microphone is also called an electrodynamic microphone because voice coils integrally mounted on a diaphragm are disposed in a magnetic gap formed in a magnetic circuit and current is generated on the voice coils by the vibration of the diaphragm as disclosed in, e.g., Patent Document 1 (Japanese Patent Application Publication No. H11-331983). The sensitivity is mostly determined by the magnetic flux density of the magnetic gap, the length of the voice coil, and the velocity of the voice coil.

The length of the voice coil cannot be so large in consideration of an output impedance and a restriction on the volume of the magnetic gap, and thus a design is generally made with 600Ω or lower. Further, the velocity of the voice coil is determined by the design of the acoustic/mechanical vibration system of the microphone unit. Considering an overall directional frequency response, an extremely high velocity is not preferable.

In the dynamic microphone, the magnetic circuit comprises a center pole piece connected to one pole of a permanent magnet and a yoke which is connected to the other pole of the permanent magnet and is arranged like a ring around the center pole piece via a magnetic gap of a predetermined width. The magnetic flux density of the magnetic gap can be increased by reducing the gap width. However, the voice coils are disposed so as to vibrate in the magnetic gap, and thus there is a limit on a reduction in the width of the magnetic gap.

For this reason, a realistic measure to further increase the sensitivity of dynamic microphones has been the use of strong permanent magnets. Thus, neodymium magnets which are compact with a large energy integral are frequently used. Moreover, neodymium magnets contain no expensive metals and thus are readily available at low cost.

However, magnetic circuits have leakage flux to some extent. Particularly in the case of the magnetic circuit used for the dynamic microphone, the magnetic gap for the voice coils is disposed between the center pole piece and the yoke, so that large leakage flux occurs in the magnetic gap.

When the leakage flux of the magnetic circuit is actually calculated with parameters including the outside diameter and thickness of the permanent magnet, the inside diameter of the yoke, and the width, height, and area of the magnetic gap, it is found that leakage flux in the magnetic gap between the center pole piece and the yoke is nearly twice or more than magnetic flux in the other parts of the magnetic circuit.

Therefore, even when a strong permanent magnet such as a neodymium magnet is used for the magnetic circuit of the dynamic microphone, magnetic flux is not effectively used. Hence, there is scope for improvement in the sensitivity of dynamic microphones.

SUMMARY OF THE INVENTION

The present invention is devised to solve the problem. An object of the present invention is to reduce leakage flux particularly in a magnetic gap of a magnetic circuit in a dynamic microphone to improve the sensitivity of the dynamic microphone.

In order to attain the object, the present invention provides a dynamic microphone comprising a magnetic circuit unit including a center pole piece connected to one pole of a first permanent magnet and a yoke which is connected to the other pole of the first permanent magnet and is arranged like a ring around the center pole piece via a magnetic gap of a predetermined width, a diaphragm having voice coils disposed so as to vibrate in the magnetic gap, and a resonator which has a front acoustic terminal and is disposed at the front of the diaphragm, the dynamic microphone further comprising a second permanent magnet disposed on a part of the resonator so as to face the center pole piece, the second permanent magnet being polarized in such a way that the same poles of the first permanent magnet and the second permanent magnet face each other.

According to a preferred embodiment, a wire net is disposed at the front of the resonator in such a way that the front of the resonator is covered with the wire net, the wire net being magnetically connected to the other pole of the second permanent magnet.

With this configuration, the second permanent magnet is dispose on a part facing the center pole piece and the same poles face each other, so that magnetic flux from the center pole piece (or yoke) to the yoke (or center pole piece) is reduced by the magnetic flux of the second permanent magnet and the magnetic flux density of the magnetic gap increases accordingly. Thus, the sensitivity of the dynamic microphone is further improved.

Further, the other pole of the second permanent magnet is covered with a wire net (acting as a guard net) so as to substantially form a closed magnetic circuit. Hence, it is possible to further reduce leakage flux occurring in the magnetic gap.

DETAILED DESCRIPTION

Figure 1:
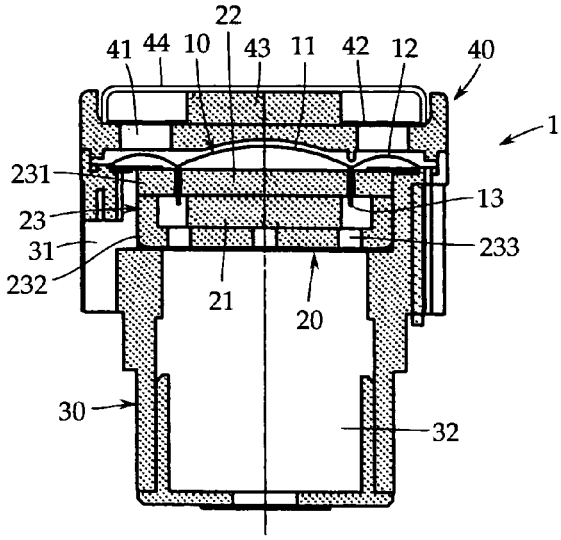
FIG. 1 is a sectional view showing the internal structure of a microphone unit provided in a dynamic microphone of the present invention.
Figure 2:
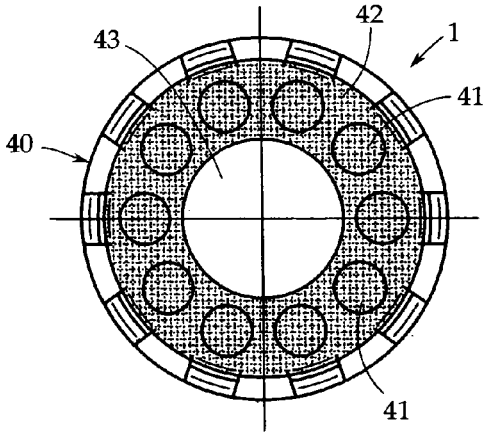
FIG. 2 is a plan view showing the microphone unit.
Figure 3:
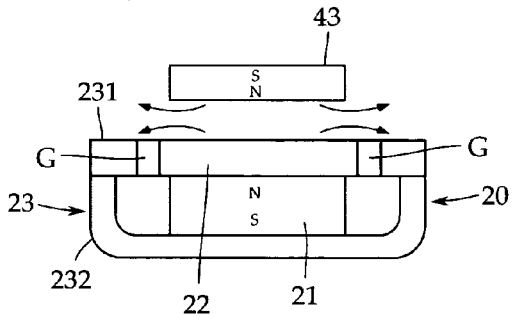
FIG. 3 is a schematic diagram for explaining the operation of the present invention.

Referring to FIGS. 1 to 3, an embodiment of the present invention will be discussed below. The present invention is not limited to the embodiment. FIG. 1 is a sectional view showing the internal structure of a microphone unit provided in a dynamic microphone of the present invention. FIG. 2 is a plan view of FIG. 1. FIG. 3 is a schematic diagram for explaining the operation of the present invention.

As shown in FIG. 1, a microphone unit 1 comprises a diaphragm 10 and a magnetic circuit unit 20 as a basic configuration. For example, when the microphone unit 1 is used as a vocal microphone, the microphone unit 1 is preferably attached to one end of a cylindrical grip (not shown) via a shock mount composed of a rubber elastic body.

The dynamic microphone of the present invention may be either of an omnidirectional or unidirectional microphone. In this example, the dynamic microphone is unidirectional and thus a rear acoustic terminal 31 and a cylinder 30 having an air chamber 32 of a predetermined volume are provided on the back of the magnetic circuit unit 20. FIG. 1 illustrates only one rear acoustic terminal 31. In an actual configuration, two or more rear acoustic terminals 31 are disposed at regular intervals.

The diaphragm 10 has a typical center dome 11 and a sub dome 12 which is integrally formed around the center dome 11. Voice coils 13 are integrally connected, e.g., with adhesive to a boundary between the center dome 11 and the sub dome 12 on the back of the diaphragm 10.

The magnetic circuit unit 20 has a permanent magnet (first permanent magnet) 21 shaped like a disk. A center pole piece 22 shaped like a disk is disposed on one pole of the permanent magnet 21. A yoke 23 is disposed on the other pole of the permanent magnet 21. In this example, the one pole on the side of the center pole piece 22 is the north pole of the permanent magnet 21 and the other pole on the side of the yoke 23 is the south pole of the permanent magnet 21.

In this example, the yoke 23 includes a ring-shaped yoke plate 231 which is coaxially disposed around the center pole piece 22 via a magnetic gap G (FIG. 3) of a predetermined width and a support yoke 232 which is almost shaped like a disk and supports the yoke plate 231. A plurality of holes 233 connecting to the air chamber 32 in the cylinder 30 are provided in the bottom of the support yoke 232.

In the diaphragm 10, the outer edge of the sub dome 12 is supported by the outer edge of the cylinder 30 in such a way that the voice coils 13 are vibrated while being inserted in the magnetic gap G. The sub dome 12 is positioned on the rear acoustic terminal 31 and sound waves from the rear acoustic terminal 31 act on the back of the diaphragm 10.

In the microphone unit 1, a resonator 40 for particularly improving a high frequency response is provided on one end of the cylinder 30 in such a way that the diaphragm 10 is entirely covered with the resonator 40. Also referring to FIG. 2, the resonator 40 has a plurality of openings acting as front acoustic terminals 41. The front acoustic terminals 41 are covered with a guard mesh 42 composed of a wire net for preventing, for example, dust of iron powder and screws from entering the microphone unit 1 in a manufacturing process. The resonator 40 and the cylinder 30 are made of a synthetic resin (non-magnetic material).

As shown in the schematic diagram of FIG. 3, in this example, magnetic flux from the center pole piece 22 to the yoke 23 is generated in the magnetic gap G of the magnetic circuit unit 20. The voice coils 13 are vibrated in the magnetic gap G in response to the vibration of the diaphragm 10, so that current is generated on the voice coils 13 according to Fleming's right-hand rule.

In the dynamic microphone, current generated on the voice coils 13 is outputted as a voice signal. Therefore, the magnetic flux density of the magnetic gap G determines the sensitivity of the microphone unit 1. As described above, the magnetic gap G has the largest leakage flux.

In order to minimize the leakage flux, a permanent magnet (second permanent magnet) 43 is disposed on a part of the resonator 40 so as to face the center pole piece 22 in the present invention. The permanent magnet 43 is polarized in such a way that the same poles of the permanent magnet 43 and the permanent magnet 21 face each other. That is, in this example, since the north pole is present on the side of the center pole piece 22, the permanent magnet 43 is disposed with its north pole facing the center pole piece 22.

With this configuration, as shown in FIG. 3, magnetic flux generated from the permanent magnet 43 reduces leakage flux in the magnetic gap G. Accordingly, the magnetic flux density of the magnetic gap G is increased and the sensitivity of the microphone is improved.

For example, in the magnetic circuit unit 20 where the permanent magnet 21 was 12 mm in diameter, four permanent magnets having a diameter of 12 mm and a thickness of 2.5 mm were stacked and arranged as the permanent magnets 43 on a part facing the center pole piece 22 of the resonator 40. In this case, the sensitivity of the microphone was increased by 1.7 dB. This means that the magnetic flux density of the magnetic gap G was increased by 17%.

In order to enhance the effect of the permanent magnet 43, as shown in FIG. 1, it is preferable that the other pole (south pole in this example) of the permanent magnet 43 is covered with a cap-like wire net 44 acting as a guard net to form a closed magnetic circuit. In this case, the guard mesh 42 of the front acoustic terminal 41 may be omitted. Moreover, a punching metal (porous metal plate) may be used instead of the wire net.

In the example, the permanent magnet 43 is disposed at the front of the resonator 40 (opposite side from the diaphragm). In some cases, the permanent magnet 43 may be disposed on the back of the resonator 40 (on the side of the diaphragm). Further, the permanent magnet 43 may be entirely or partially embedded into the resonator 40.

The present application is based on, and claims priority from, Japanese Application Serial Number JP2004-175266, filed Jun. 14, 2004, the disclosure of which is hereby incorporated by reference herein in its entirety.

The invention claimed is:

1. A dynamic microphone, comprising:

a cylindrical member including an air chamber having a predetermined volume therein, a magnetic circuit unit provided on one end of the cylindrical member, and including a yoke having a ring shape, a first permanent magnet mounted on the yoke and having a disk shape, the first permanent magnet being polarized in a thickness direction, and a center pole piece mounted on the first permanent magnet, the yoke surrounding the center pole piece for defining a magnetic gap with a predetermined width therebetween, a diaphragm provided on the magnetic circuit unit, and having a peripheral portion supported by a periphery of the magnetic circuit and a voice coil disposed in the magnetic gap to vibrate therein, a resonator disposed so as to substantially entirely cover the diaphragm and having a front acoustic terminal, and a second permanent magnet disposed on the resonator so as to face the center pole piece, and having a diameter substantially same as that of the first permanent magnet, said second permanent magnet being polarized in a thickness direction and having a lower surface as a pole same as that of an upper surface of the first permanent magnet.

2. The dynamic microphone according to claim 1, further comprising a wire net disposed at a front of the resonator in such a way that the front of the resonator is covered with the wire net, the wire net being magnetically connected to an upper surface of the second permanent magnet.

3. The dynamic microphone according to claim 1, wherein the second permanent magnet is arranged and polarized so as to reduce leakage flux in the magnetic gap.

4. The dynamic microphone according to claim 3, further comprising a guard mesh provided on the resonator so as to cover the front acoustic terminal.

* * * * *